United States Patent [19]

Hall

[11] Patent Number: 4,577,346

[45] Date of Patent: Mar. 25, 1986

[54] ATHLETIC PADDED GARMENT

[76] Inventor: Bradley G. Hall, 60 Redcar Ave., Islington, Ontario, Canada, M9B 1K1

[21] Appl. No.: 675,776

[22] Filed: Nov. 28, 1984

[51] Int. Cl.[4] ..... A41D 13/00

[52] U.S. Cl. ..... 2/2

[58] Field of Search ..... 2/2, 2.5

[56] References Cited

U.S. PATENT DOCUMENTS 2,892,193 6/1959 Sowle ..... 2/2

4,325,148 4/1982 Livernois ..... 2/2

*Primary Examiner*—Louis K. Rimrodt

[57] ABSTRACT

A protective sports garment has a plurality of flat rings designed to extend about the wearer adjacent the waist area. The rings are mounted to partially overlap in any normal attitude of the athlete and the overlap may then alter to conform to the athletes movements.

19 Claims, 9 Drawing Figures

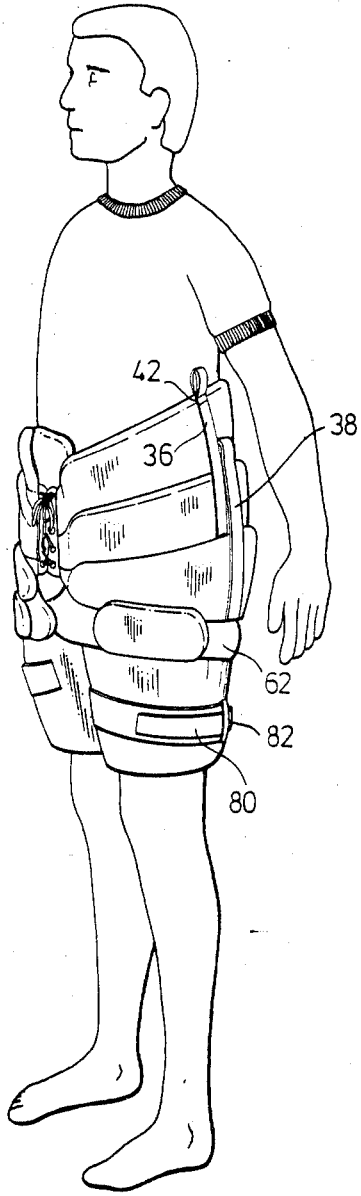
FIG. 1.
FIG. 2.
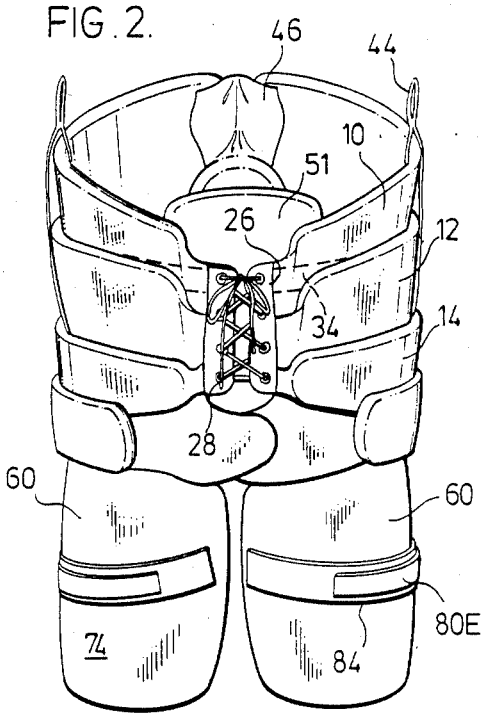
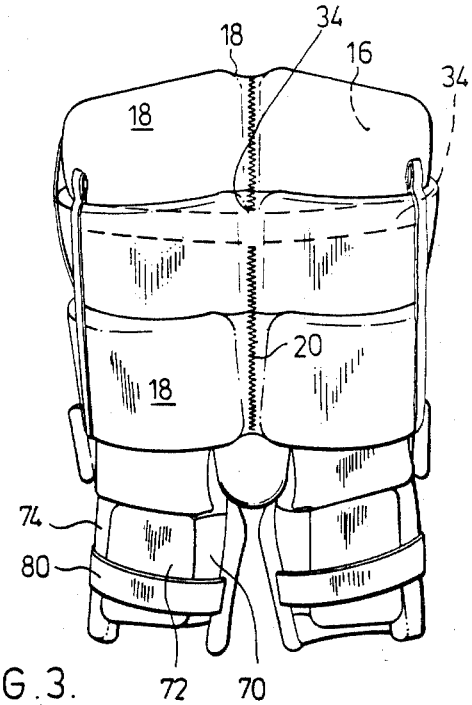
FIG. 3.

ATHLETIC PADDED GARMENT

This invention relates to a protective garment.

The garment provides padded protection for vulnerable areas above and below the waist of the wearer but with the design of the garment arranged to provide the desired protection while impeding the movement of the wearer as little as possible.

Although the inventive garment is suitable for hockey players it will be obvious that it is also suitable for other sports and may be worn by members of both sexes.

The garment is designed to provide a plurality of flat rings having padded material designed to extend about the body of the wearer adjacent the waist. Said rings are each generally flat, relatively thin members arranged to have their long dimension extending about the body and their width dimension extending upwardly and downwardly on the wearer's body. Each of the rings is vertically displaced from the adjacent ring but is arranged to have a limited overlap therewith. The rings are attached to each other at the front and preferably at the rear of the garment but at the sides are allowed to move up and down relative to each other to conform to the movements of the wearer. Means operating between adjacent ring members preferably limit such relative up and down movement to a maximum displacement of the upper relative to the lower of two adjacent members while allowing relative movement below such limit. Since adjacent ones of the generally flat rings will always have an overlap at some part of their extents the result, when the body flexes to (say) the left, is to cause this overlap to increase on the left side of the body and, decrease on the right. The rings collectively conform to the wearer's movements and provide minimum resistance. The displacement limiting means limits expanding displacement of the rings to an amount which will leave the body minimally exposed to exterior impacts (such as from opponents, their equipment, sticks, bats, pucks, balls or the like), between overlapping pads. The arrangement is superior, in allowing an athlete's freedom of movement, to prior arrangements where pads have been connected to conform to a certain extent with the body but which tend, on bending, to interfere with each other on the small radius side of the body but allow too little expansion relative to each other on the large radius side of the body.

The application therefore deals with a plurality of flat padded rings connected so that adjacent pairs of rings overlap to a greater or lesser extent depending on the attitude of the wearer's body. Accordingly, the relative movement between two adjacent rings in the "expansion direction" or "expanding" refers to relative movement in a sense to decrease the overlap between such rings, including the possibility of attitudes where some parts of the rings do not overlap at all; and relative movement between two adjacent rings: in the "contraction direction"; or "contracting"; refers to relative movement in a sense to increase the overlap between them.

Preferably adjacent rings are rearwardly attached by an elastic connection which will allow such adjacent rings to move relatively in the expansion direction at the rear, preferably to a position where the vertically adjacent padded strips of adjacent rings have no overlap and preferably in fact where such vertically adjacent padded strips assume a slightly spaced arrangement. Because overlap in the preferred arrangement is maintained at the front when there is no overlap at the back, the padded strips of the flat rings act as their own guides and will naturally assume their overlap arrangement (guided by the continuing overlap at the front) when the wearer, formerly bent forward to produce the lack of vertically adjacent padded strip overlap at the rear, then straightens up. Thus the front overlap of the padded strips prevents interference of these padded strips with each other when adjacent strips of adjacent rings move in a contraction direction.

Preferably, and with reference to both the second previous paragraph and in the preferred arrangement three flat rings are provided and the padded strip overlap is arranged so that, relative to the wearer's body, the upper ring is on the opposite side of the middle ring from the lower ring. This ensures that, in the case of extreme flexure, the padded strips of the upper and lower rings cannot interfere since they are on opposite sides of the middle ring.

Preferably, and with reference to any one of that previous paragraphs, the means limiting the expansion movement of the padded strips of adjacent rings are loops surrounding a pair of adjacent rings and allowing extensive freely contracting movement but restricting the expansive movement to the desired amount. Such loops are customarily located along each side of the rings and are preferably connected (preferably by stitching) to one of the bands merely to prevent migration of the loop around the body.

The preferred method of constructing the rings is to provide relatively flat padded strips of the contour desired enclosed (preferably by stitching) in an envelope of two way stretch resilient material. The two way stretch materials of different rings are then stitched together at the back to provide a resilient, stretchable connection between the rings. The pads are connected to each other at the front, preferably to lacing plates which mount means joining the garment at the front (usually by lacing utilizing lace holes in opposing plates).

By the term "lacing plates", we refer to the reinforced areas of the garment carrying lacing grommets. These plates are not usually rigid but are of strong and sometimes thickened material.

By the term "padded rings" or "padded members" we include not only rings or members of two or more pieces including the padding but also rings or members which are composed solely of a piece of padding in the form and with the connections described.

The preferred embodiment of the invention described so far has referred to a plurality of padded rings connected at the front and rear and free to move relatively vertically in between. Where such rear attachment is used the padded members need not take the character of separately identifiable rings extending about the body from the front to the front thereof. Instead and within the scope of the invention, pluralities of padded members may extend between the front attachment and the rear attachments, on each side of the body so that such padded members have the character of semirings on each side of the body but do not carry their separate character across the rear connection.

In drawings which illustrate a preferred embodiment of the invention:

FIG. 1 is a perspective view of the garment being worn,

FIG. 2 is a front view of the garment,

FIG. 3 is a rear view of the garment,

Figure 4:
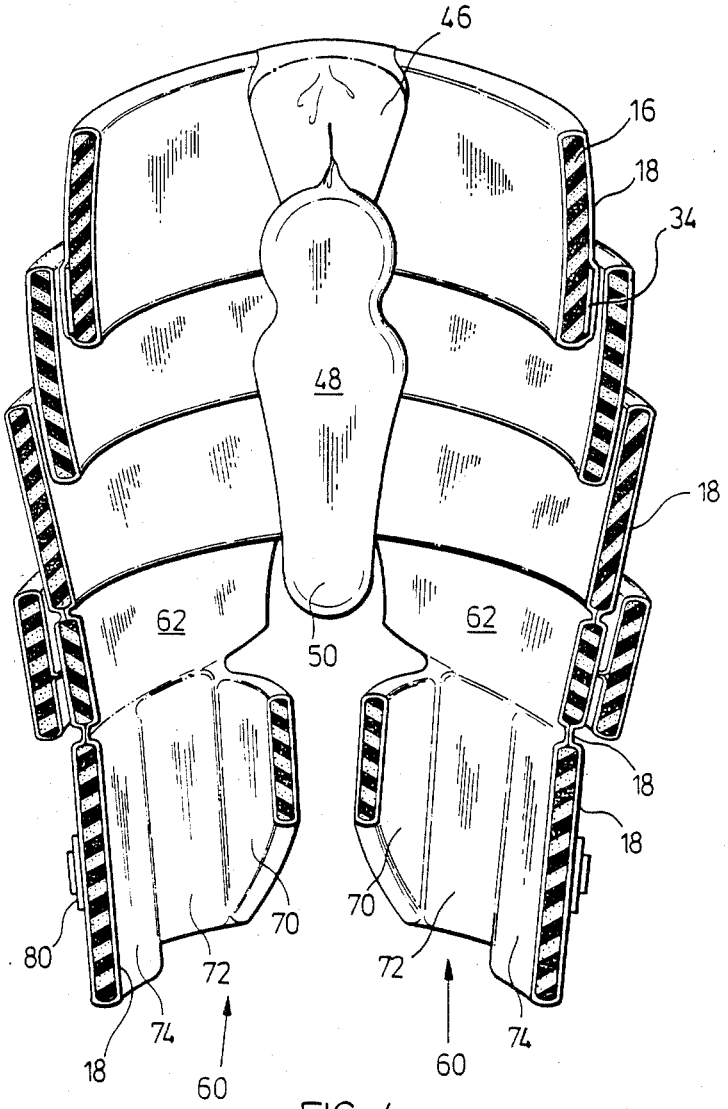
Figure 5:
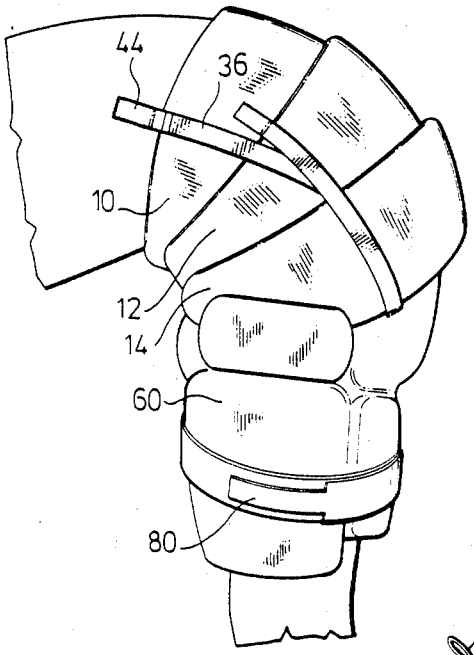
Figure 6:
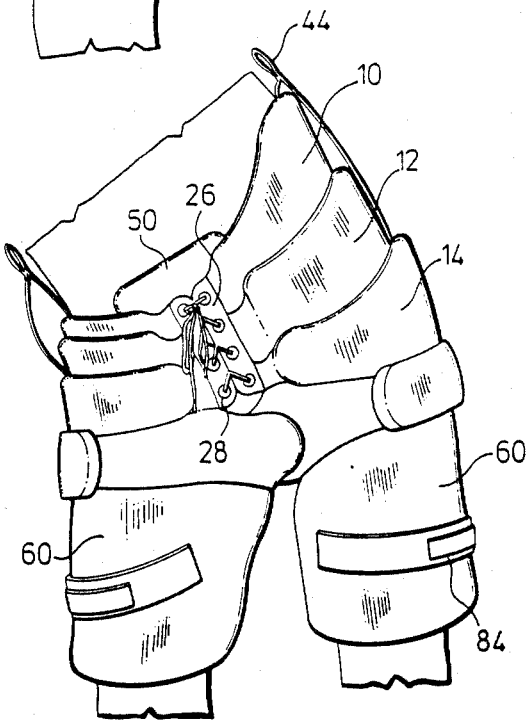
Figure 7:
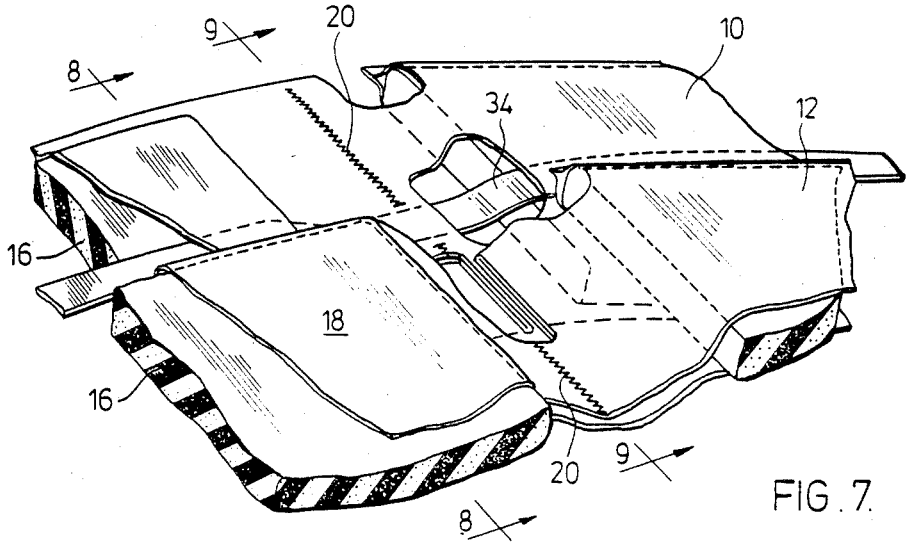
Figure 8:
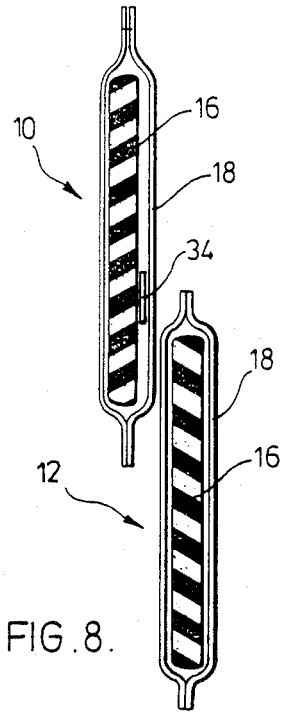
Figure 9:
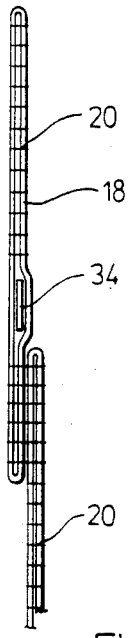

FIG. 4 is a partially cut-away view of the garment looking at the inside of the rear portion, FIG. 5 is a side view of the garment being worn with the wearer bending forwardly, FIG. 6 is a front view of the garment being worn with the wearer leaning to the wearer's right, FIG. 7 is a partially broken away perspective showing the upper portion of the rear of the garment and the relation of the rings thereat, in the upright position of the wearer, FIG. 8 is a section along line 8—8 of FIG. 7, and FIG. 9 is a section along line 9—9 of FIG. 7.

In a preferred form of the invention described above, three flat padded rings 10, 12, 14 are provided designed to extend about the body of the wearer, in the waist area. Each ring comprises a padding strip 16 designed to run down one side of the body and being joined to its counterpart strip 16 on the other side of the body at the rear of the garment. In the preferred embodiment, such junction is achieved by enclosing each pair of pads 16 in two way stretch material 18 preferably stitched about the pads 16 but not stitched to the pads. Such stitching at the rear of the garment is shown as stitching 20 (see particularly FIGS. 7,8 and 9) between the two side pads of a ring to form separate pockets for them. The stitching 20 is also used to attach adjacent ring members to each other by the junction of the two way stretch material 18 of one ring to the two way stretch material 18 for the next at stitching 20. It will be noted that such stitching is performed in such a way, see FIGS. 8 and 9 as to achieve the desireed relationship between adjacent plates. Thus, in the upright attitude of the wearer as shown in FIGS. 1–3 and 7–9, the stitching 20 provides for the arrangement of the rear portion of ring 10 inside of, upward of, and having a small overlap with ring 12 in the upright attitude of the wearer. Similarly the stitching 20 at the rear provides for the arrangement of ring 12; inside of upward of, and having a small overlap with ring 14 in the upright attitude of the wearer.

Each ring is joined to an adjacent ring at the front by sewing the two way stretch material 18 of each ring to the lacing plate 26. Each lacing plate is a sewn laminate of the two layers of the ring's two way stretch material 18 covered on each side by a layer of tough fabric and stitched together. The tough cover fabric is preferably nylon, and the two way elastic stretch material 18 may be obtained from Britex Limited, P.0. Box 460, Bridgetown, Nova Scotia, Canada. The lacing plate 26 is provided with a series of lacing holes defined by grommets 28, as shown and opposite lacing plates 26 are laced together as shown. The two way material 18 of each ring is sewn to the next and to the lacing plate to define the overlapping relationship desired between the adjacent rings 10, 12, 14, and to enclose the two padding strips 16 in each ring. Thus, in the preferred embodiment, the two way stretch material 18 for each ring is sewn to the two way stretch material of the adjacent ring and to the plate to place the padding strip 16 of the flat ring 10 upward of but overlapping with and inwardly disposed from the vertically adjacent strip 16 of flat ring 12. Similarly the sewing is such that the padding of flat ring 12 is upward of but overlapping with and inwardly disposed from the padding of ring 14.

It will be noted that the zig-zag stitching 20 (see FIGS. 3 and 7) allows widening and narrowing of the "v's" of the material to conform to the vertical stretching and contraction of the stitched two way stretch material.

It should be noted that, in the preferred arrangement, there is a distinction between the method of connecting the rings 10, 12, 14 at the front and back. The connection of the rings at the back is elastic (through the elasticity of material 18) to allow the padding strips 16 of adjacent rings to expand to a position where there is no overlap of the padding 16 and in fact where there is a space between the padding 16 of adjacent rings. However, the attachment at the front always maintains an overlap between forward extents of vertically adjacent padding strips 16 of rings 10 and 12 and of rings 12 and 14. As a result, if the vertically adjacent padding strips 16 of rings 10 and 12 respectively, move at the back, to a position of non overlap they will be guided back to the desired overlap when the player straightens due to the continuing overlap at the front. The same is true of the padding strips 16 of rings 12 and 14.

A belt-like effect for securing the garment to the wearer is preferably provided by fastening a non stretchable strap 34 at its ends to each lacing plate 26 and the strap is threaded about ring 10 inside of the outer layer of two way stretch material 18 for ring 10 and outside ring 10's padding strips 16. It will be noted that the stitching 20 connecting one ring to the other at the back is interrupted to allow passage of the strap 34 therethrough. FIGS. 7,8 and 9 show the detail of the relationship of strap 34 to stitching 20 and to the stretch material 18 and padding 16 of the upper and middle rings. These Figures further illustrate how the padding strips 16 of each ring stop short of stitching 20 so that the latter merely stretches two layers of the material 18 to each other, corresponding to each ring. FIG. 9 shows how stitching 20 connects the two layers of material 18 for ring 10 to the two layers of material for ring 12 to provide for the overlap of the vertically adjacent strips 16 of the two rings (see FIG. 8) in the upright attitude of the wearer. The strap 34 therefore provides a non stretching connection about the wearer which performs the function of a belt when the lacing plates 26 are laced together at the front but which does not interfere with the flexure and relative movement of the three rings 10, 12, 14 relative to each other and interferes very little with the absolute movement of ring 10. Alternatively, the "belt" connection may be provided by eliminating the strap 34 and providing (not shown) a connection between the two padding strips 16 of ring 10 at the rear and a connection (also not shown) between the front of the same padding strips and the adjacent lacing plate 26. However, the arrangement shown using the strap 34 and eliminating connections to the padding strips is preferred.

The texture and material of the flat padding strip will vary with the sport for which the garment is designed. Thus with a garment for hockey, the padding will be relatively hard and highly impact resistant. In sports with less impact risk the padding may be made of a softer type. The lacing of the front plates plus the strap 34 provides the "fit" of the garment.

The limits of expanding movement of ring 10 relative to ring 12 on each side intermediate the front and back so provided by strap 36 which forms a loop about the two rings, and is located approximately midway along the sides of the two rings. With the strap 36 constructed of non-stretchable material, the length of the loop determines the limit of the expansion of the rings 10 and 12 relative to each other at its location. The loop therefore defines the minimum side overlap between the rings 10 and 12 while allowing the rings to overlap to a greater degree. The strap loop is attached (by stitching not shown) to the bottom of ring 12 and at 42 to the top of ring 10, in each case over a short extent to prevent migration of the strap from its desired position on the side of the wearer. Above the main loop the strap may provide a smaller loop 44, as shown, to assist the wearer in pulling the garment on. Straps 38 from loops on each side connect rings 12 and 14 in exactly the same manner as straps 36 connected rings 10 and 12 and are anchored in the same manner.

A padding extent 46 enclosed by the two way stretch material 18 is located inwardly of the rearward extent of the ring 10 and is located to protect the wearer's body against impacts received between padded strips 16 of ring 10. A second padded extent 48 also sewn in the two way stretch material 18 overlaps, in the normal attitude of the wearer, with the padded extent 46 but extends downward to form tail piece 50 projecting below lower ring 14. Extent 48 therefore protects the wearer for impacts between the pairs of padded strips 16 for rings 12 and 14. When the wearer's outer garment e.g. hockey pants or pants for another sport is placed thereover, it bends tail piece 50 between the legs of the wearer for protection. It will be noted that enclosed pads 46 and 48 cover any exposed gaps between the vertically adjacent padded strips of rings 10 and 12 or 12 and 14 when the wearer is bent forward in the attitude of FIG. 5.

It will be noted that: the rings 10, 12, 14, the padding of member 46 and the padding of members 48–50 are each connected to each other solely by their enclosing areas of two way stretch material 18. (Similarly the two padded strips 16 of a ring are only connected by such material). Thus considerable flexibility is allowed for each padded unit to move relative to the others to allow freedom of movement to the wearer while protecting him.

A pad 51 protects the area between and above the lacing and is attached to the rings 10 and 14 by enclosing two way stretch material 18 and is worn to protect the wearer against contact with lacing plates 26 and the lacing and impacts thereon. Again the joining two way stretch material allows flexibility of movement between pad 51 and the pads of rings 10,12 and 14.

The upper portions of the hips of the wearer are protected by padded members 60 which are connected to lower rings 14 by intermediate padded members 62, the connections between the padding strips 16 of rings 14 and the pads of the members 62 and between the pads of members 62 and the pads of member 60, here again preferably being by the two way stretch material 18 forming closed pockets for the respective pads of each member. As best shown in FIG. 4 pad 60 is composed of three pads 70, 72 and 74 which each comprise padded strips connected to each other and to member 62 by the enclosing two way stretch material.

Thus the pads 70, 72, 74 are articulated by material 18 connecting them to allow different angular attitudes to each other. Adjustment for various leg sizes is provided by strap 80, anchored on the outside of the stretch material at the outside of the hip and designed to extend around the legs through suitable loops 82. The outside of the strap at and adjacent its attachment to member 74 at 84 is provided with exposed material of one type of hook and loop fastening material, while the inside of the free strap end 80E is provided with the other type of hook and loop fastening material. The material of one of the types is made of sufficient length to provide the required degree of adjustability.

The arrangement in providing a plurality of rings which have limited up and down relative free movement on the sides, provides the desired protection with minimal interference with the freedom of movement of the wearer. A negative advantage is the design of the hip protectors for each leg to be completely independent of each other. Prior protective garments having hip protectors have material joining their hip members across the crotch area. This is found to greatly increase the discomfort of the wearer since the added material blocks the free flow of air to and from the crotch area. The connecting material also may reduce the freedom of movement of the hip protectors relative to each other. It is reiterated that the protection in the crotch area is supplied other than through the inventive garment usually by the athletic supporter and protectors carried thereby.

It is reiterated that although a plurality of rings are shown in the preferred embodiment maintaining, to some extent their separate character across the stitching 20 at the rear of the garment, the invention covers the alternative where a plurality of padded members or semi-rings are located on each side of the body and connected to the lacing members 26 at the front and are connected to each other at the back where they may not have the character of separate rings. It is noted that although such padded members or semi-rings lose the character of separate members at the back attachment, the back attachment may still be such that padded members or semi-rings are elastically attached to each other, such elastic relationship applying to the rear connections between padded members for opposite sides of the body and the rear connection between different padded members on the same side of the body.

The embodiments of the invention in which an exclusive property or privilege is claimed are defined as follows:

1. Protective sports garment comprising:

a plurality of padded generally flat rings designed to extend about the wearer adjacent the waist area, the length dimension of said rings extending about the waist and the width dimension being approximately parallel to the wearers body, when worn, each of said padded rings being attached to adjacent extents at attachment locations at the front and back of the garment, arranged in overlapping relationship in the upright attitude of the wearer, adjacent ones of said rings being connected to allow relative movement therebetween in the extents between the front and the back of the garment.

2. Protective equipment as claimed in claim 1 wherein the lowest of said extents supports a protector for the upper portion of the hip of each leg.

3. Protector as claimed in claim 2 wherein said hip protectors are connected to opposed sides of said lowest extent but are unconnected to each other.

4. Protective sports garment as claimed in claim 1 wherein each said extent is joined intermediate its ends to the adjacent extent by a connection limiting the minimum overlap but allowing greater overlap with the flexure of the wearer's body.

5. Protective garment comprising a plurality of pairs of padded semi-rings said semi-rings each being generally flat relatively thin members arranged to have their long dimension extending about the body and their width dimension extending approximately parallel to the wearers body when worn, each semi-ring being attached to the other semi-rings at a front attachment location, each semi-ring being attached to the other semi-ring of the pair at the rear of the wearers body when worn, each ring being movable up and down relative to a vertically adjacent ring at locations other than at said front attachment location, said front attachment location being designed to maintain the padding vertically adjacent ones of said semi-rings in partially overlapped relationship adjacent said front attachment location.

6. A protective garment as claimed in claim 5, including:

means limiting the relative upward movement of an upper ring semi-relative to an adjacent lower semi-ring at locations spaced from said front attachment location.

7. A protective garment as claimed in claim 6, including an elastic connection between adjacent semi-rings at the rear thereof.

8. A garment as claimed in claim 6 wherein said limiting means comprises a loop of material surrounding vertically adjacent pairs of semi-rings and allowing limited movement of said rings toward increasing overlap positions.

9. A garment as claimed in claim 8 wherein a pair of said loops are provided on opposite sides of the garment intermediate the front and back thereof and designed to limit relative upward movement of the upper semi-ring to a displacement overlapping with the lower semi-ring.

10. A protective garment as claimed in claim 5, including an elastic connection between adjacent semi-rings at the rear thereof.

11. A garment as claimed in claim 10 wherein said elastic connection is formed by connecting the two way stretch material of adjacent semi-rings, at the rear.

12. A protective garment as claimed in claim 5, wherein said padded semi-rings comprise strips of padding enclosed in a cover of two way stretch material.

13. A garment as claimed in claim 5 wherein three semi-rings are provided on each side and on each side the overlap between the lower and middle semi-rings on the one hand and between the middle and upper semi-rings on the other hand is such that, said upper semi-ring is on the opposite side of the said middle semi-ring from said lower semi-ring.

14. Protective garment comprising:

a connecting member designed when worn to be located at the front of the body in the vicinity of the waist area, a plurality of semi-rings of flat relatively thin padded members arranged to be located on each side of the wearer's body and arranged, when worn, to have their long dimension extending about the body and their width dimension approximately parallel to the wearer's body, one end of each padded member being attached to said connecting member, the other ends of said padded members being connected to each other at the rear of the body, when worn, each semi-ring padded member being movable up and down relative to an adjacent padded member of such plurality, at locations between said front attachment location and said connection at the rear of the wearer's body, said attachment of said padded members being designed so the padding of said members is in partially overlapped relationship adjacent said front attachment location.

15. A protective garment as claimed in claim 14 including:

means limiting the relative upward movement of an upper ring relative to an adjacent lower ring at locations intermediate the front and rear connections.

16. A protective garment as claimed in claim 15 wherein the rear connection between said padded members is elastic.

17. A protective garment as claimed in claim 15 wherein said limiting means comprises a loop of material surrounding vertically adjacent pairs of semi-rings and allowing limited movement of said rings toward increasing overlap positions.

18. A protective garment as claimed in claim 14 wherein the rear connection between said padded members is elastic.

19. A protective garment as claimed in claim 14 wherein said padded members comprise strips of padding enclosed in a cover of two way stretch material.

* * * * *